United States Patent [19]

Schulz

[11] Patent Number: 4,853,550

[45] Date of Patent: Aug. 1, 1989

[54] DEVICE FOR IRRADIATING AN OBJECT WITH A TRANSPORTABLE SOURCE GENERATING THERMAL NEUTRONS

[75] Inventor: Wolfgang Schulz, Wunstorf, Fed. Rep. of Germany

[73] Assignee: Brown, Boveri Reaktor GmbH, Mannheim, Fed. Rep. of Germany

[21] Appl. No.: 912,932

[22] Filed: Sep. 26, 1986

[30] Foreign Application Priority Data

Sep. 28, 1985 [DE] Fed. Rep. of Germany ..... 3534686

[51] Int. Cl.[4] ..... G21G 4/02

[52] U.S. Cl. ..... 250/493.1; 250/390.01; 250/505.1

[58] Field of Search ..... 250/390 I, 390 R, 493.1, 250/503.1, 505.1, 515.1, 518.1

[56] References Cited

U.S. PATENT DOCUMENTS

| | | | |
|---|---|---|---|
| 3,659,106 | 4/1972 | Cason | 250/506.1 |
| 3,914,612 | 10/1975 | Cason, Jr. et al. | 376/114 |
| 4,300,054 | 10/1981 | Dance et al. | 250/390 I |
| 4,324,979 | 4/1982 | Bewley et al. | 250/505.1 |
| 4,464,330 | 8/1984 | Speir et al. | 250/390 R |
| 4,582,999 | 4/1986 | Dance et al. | 250/505.1 |
| 4,599,515 | 7/1986 | Whittemore | 250/518.1 |
| 4,760,266 | 7/1988 | Schulz | 250/505.1 |

FOREIGN PATENT DOCUMENTS

| | | | |
|---|---|---|---|
| 3031107 | 9/1982 | Fed. Rep. of Germany . | |
| 0706503 | 3/1954 | United Kingdom | 250/390 I |

*Primary Examiner*—Janice A. Howell
*Assistant Examiner*—William F. Rauchholz
*Attorney, Agent, or Firm*—Herbert L. Lerner; Laurence A. Greenberg

[57] ABSTRACT

A device for irradiating an object, includes a source mount, a source disposed on the source mount for generating thermal neutron rays, a moderator surrounding the source, a collimator having a ray inlet side with an inner surface and at least one funnel-shaped collimator duct for the neutron rays opening toward an object, a neutron-permeable wall separating the source mount from the ray inlet side of the collimator defining a space between the wall and the ray inlet side with an inner peripheral surface of the space, and a plastic plating disposed on the inner peripheral surface of the space and on the inner surface of the ray inlet side defining an opening of the at least one collimator duct free of the plastic plating.

5 Claims, 2 Drawing Sheets

DEVICE FOR IRRADIATING AN OBJECT WITH A TRANSPORTABLE SOURCE GENERATING THERMAL NEUTRONS

BACKGROUND OF THE INVENTION

The invention relates to a device for irradiating an object, with a transportable source which generates thermal neutrons and has a moderator, the neutron rays or beams arriving at the object through a collimator having at least one collimation duct or lane opening toward the object in funnel fashion.

Such a device is known from German Patent DE-PS No. 30 31 107. When examining certain objects such as control elements of boiling-water reactors, the irradiation time must occur within a given time frame in order to limit the disturbance of the cost-intensive operation of a nuclear reactor plant to a period which is only as long as is required for inspection work which is being simultaneously carried on. The source output of the conventional transportable neutron source is not to be increased, for weight, cost and safety reasons.

SUMMARY OF THE INVENTION

It is accordingly an object of the invention to provide a device for irradiating an object with a transportable source generating thermal neutrons, which overcomes the hereinfore-mentioned disadvantages of the heretofore-known devices of this general type and to do so in such a way that the thermal neutron stream arriving at the object is increased substantially without an increase of the source output.

With the foregoing and other objects in view there is provided, in accordance with the invention, a device for irradiating an object, comprising a source mount, a source disposed on the source mount for generating thermal neutron rays, a moderator surrounding the source, a collimator having a ray inlet side with an inner surface and at least one funnel-shaped collimator duct for the neutron rays opening toward an object, a neutron-permeable wall separating the source amount from the ray inlet side of the collimator defining a space between the wall and the ray inlet side with an inner peripheral surface of the space, and a plastic or synthetic plating, coating or lining disposed on the inner peripheral surface of the space and on the inner surface of the ray inlet side defining an opening of the at least one collimator duct free of the plastic plating.

The primary moderated neutron flux reaching the space from the neutron source through the neutron-permeable wall, is given considerable amplification in the thermal energy range by the plastic plating, since secondary moderation of such neutrons which have not yet attained the thermal neutron energy after the primary moderation, is achieved by means of the plastic coating. Finally, the coating on the ray inlet side prevents neutrons from being absorbed by the absorber material of the collimator wall. It is a further advantage that thermal neutrons are subjected to increased reflection by the plastic plating in the space.

As is well known, the conversion of the non-directional thermal neutron flux in the free space into an extracted, directional neutron stream is accomplished by means of a collimator, assuming a suitable ratio of the collimator length to the diameter of the inlet opening of the collimator (L/D), taking into consideration the required resolution quality.

In accordance with another feature of the invention, there are provided means for moving the source mount together with the neutron source relative to the collimator in axial direction and transverse to axial direction of the at least one collimation duct.

The ability to perform an adjustment transverse to the axial direction of the collimation duct, makes it possible to increase the efficiency of the neutron source, with the source output unchanged, especially in an apparatus with more than one collimating duct. The adjustability of the neutron source in the axial direction of the collimator lane allows the device to to be set to objects of different materials and geometries.

In accordance with another feature of the invention, the moderator is a solid body in which the source is disposed, and the moving means moves the solid body together with the source mount.

In accordance with a further feature of the invention, the plastic plating has an aperture formed therein defining lateral surfaces of the plastic plating diverging relative to each other as seen in direction toward the wall. This is done in order to improve the guidance of the neutrons.

Other features which are considered as characteristic for the invention are set forth in the appended claims.

Although the invention is illustrated and described herein as embodied in a device for irradiating an object with a transportable source generating thermal neutrons, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention however, together with additional objects and advantages thereof will be best understood from the following description of specific embodiments when read in connection with the accompanying drawings.

DETAILED DESCRIPTION OF THE INVENTION

Figure 1:
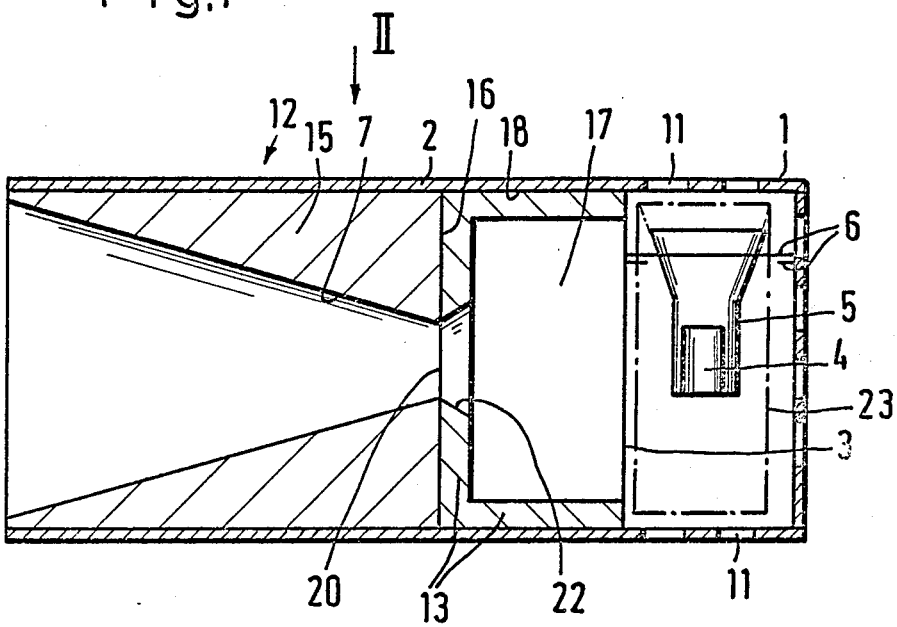
FIG. 1 is a diagrammatic, cross-sectional view of an irradiation device according to the invention.
Figure 2:
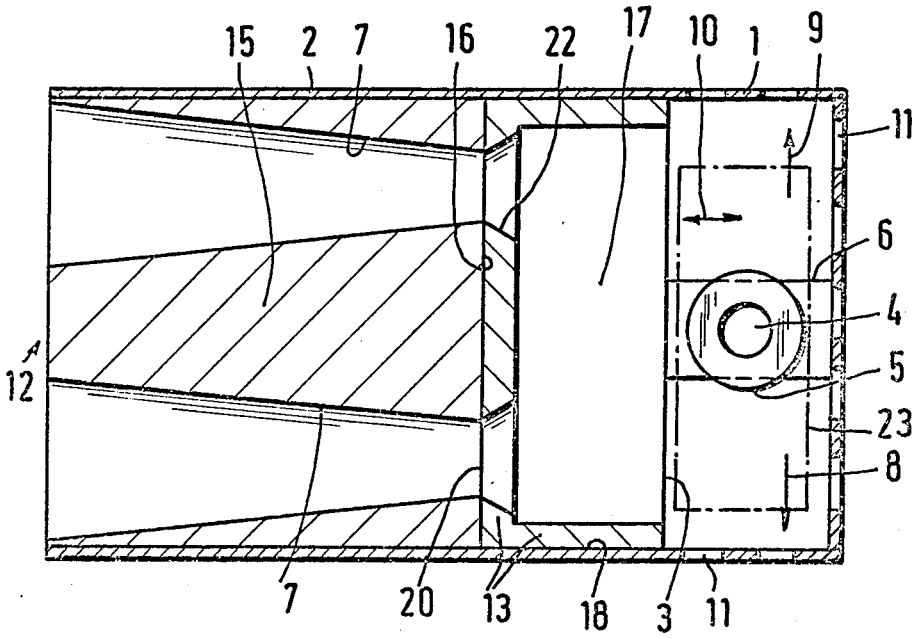
FIG. 2 is a cross-sectional view as seen in the direction of the arrow 11 of FIG. 1.

Referring now to the figures of the drawings in detail and first, particularly, to FIGS. 1 and 2 thereof, it is seen that the device includes two housing parts 1 and 2 which are separated from each other by a wall 3 of neutron-permeable material (such as aluminum). The housing part 1 contains a transportable neutron source 4 which is supported in a source mount 5 that can be removed by remote control. The source mount rests on a frame 6 which is connected to the housing part 1. Non-illustrated drive elements are associated with the frame 6, for moving the source mount 5 by remote control transverse to the axial direction of a collimation duct 7 (in the direction of arrows 8 and 9) as well as in the axial direction of the collimation duct 7 (in the direction of an arrow 10). The object to be irradiated and therefore also the device should be disposed in a water seal, especially if the object to be irradiated is a radioactive component from a reactor core. The walls of the housing part 1 formed of aluminum have openings 11 which ensure the intake of water from the environment into the interior of the housing part 1, so that this water can be used as a moderator. A solid such as polyethylene (PE) can also be used as the moderator. In this case, the removable source mount 5 is replaced by a source moderator structure which is removable by remote control and is in the form of a polyethylene block 23 shown in phantom in FIGS. 1 and 2. The block 23, which is brought into the position of the source mount 5, at the same time represents a source mount for the neutron source 4.

The PE block as well as the source mount 5 can be moved transversely (in the direction of the arrows 8 and 9) and in the axial direction (the direction of the arrow 10) by remote control, through non-illustrated drive and guiding elements. By inserting different PE blocks which vary as to the geometric shapes thereof and as to the positioning of the neutron source 4 within the respective PE block, it is possible to match the moderating properties to the specific requirements of the object to be irradiated (object geometry/material). The housing part 2 is formed of aluminum and is closed on all sides. It contains a collimator 12 which has as least one collimating duct 7. The two collimator ducts 7 which are shown are flared toward the non-illustrated object in funnel-fashion and preferably have a rectangular cross section. The surface 15 of collimator duct is formed by a neutron-absorbing material.

The geometric dimensions of the collimator duct 7, such as the ratio of the collimator length L to the diameter D of the inlet of the collimator, are chosen according to the size of the image of the section of the object and by considering the required geometric resolution or the image quality, in such a manner that a clear statement can be made as to the nature of the object to be examined with irradiation times that are as short as possible.

A space 17 filled with air or another gas which only has a connection leading toward the collimator, is formed between the wall 3 which separates the housing parts 1 and 2 from each other and a ray inlet side 16 of the collimator 12. Peripheral surfaces 18 defined by the space 17 and the ray inlet side 16 opposite the wall 3 are provided with a polyethylene plating or coating 13. The ray inlet side 16 is only interrupted in the vicinity of an inlet opening 20 of the collimator 12. The neutrons moderated in the vicinity of the housing part 1 are transported into the space 17 through the wall 3 formed of neutron-permeable material.

Figure 3:
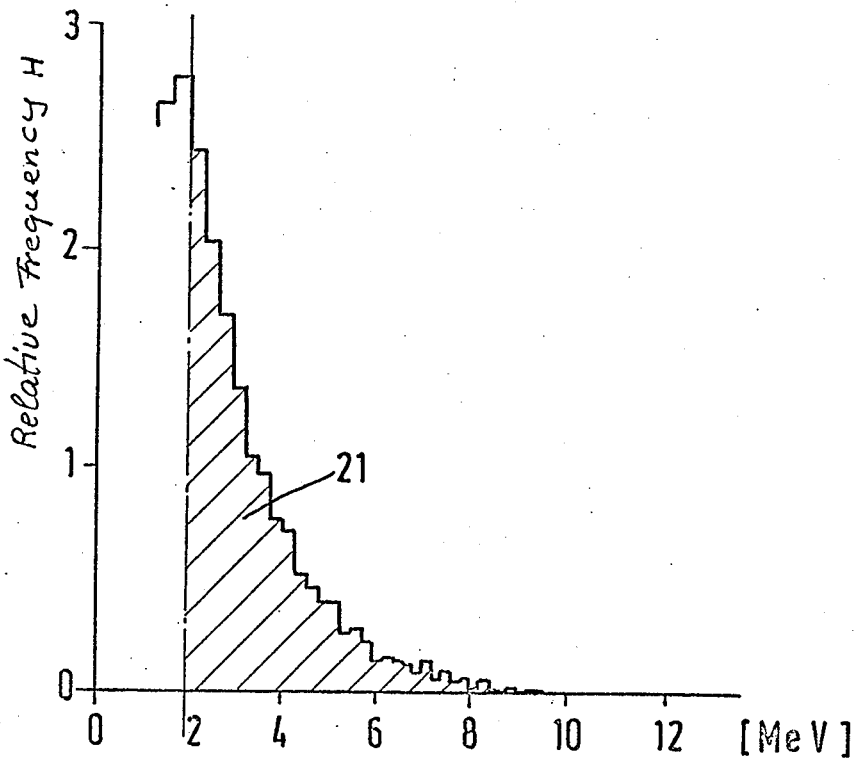
FIG. 3 is a graph of a neutron spectrum of a Cf-252 neutron source.

Referring to the neutron spectrum shown in FIG. 3 for a californium-252 neutron source, it will be seen that only a part of the neutrons arriving in the space 17 is equipped with a thermal energy range suitable for the irradiation of objects with a large thermal action cross section. FIG. 3 shows the relative frequency H on the ordinate and the energy in MeV, on the abscissa. A not inconsiderable part of the primary neutrons, indicated by shading 21, has a higher primary energy above 2 MeV. The polyethylene coating 13 causes a secondary moderation by decelerating a large part of the neutrons with higher primary energy ($E>2$ MeV) to thermal energy ranges. By providing the polyethylene-coated space 17, the neutron yield can be increased substantially for the same source output. By polyethylene plating or coating the space 17, increased reflection is additionally achieved of the primary as well as of the secondary moderated neutrons. The thickness of the polyethylene coating 13 as well as the size of the space 17 depends on the neutron spectrum of the neutron source used. In the region of the collimator aperture 20, the plating or coating 13 is enlarged in the direction toward the wall 3. This oblique introduction of the neutrons surprisingly yields a considerable improvement of the neutron extraction in the sense that irregularities of the neutron flux density are reduced to a justifiable minimum in the area of interest of the plane of the object which is connected with improper picture reproduction. Depending on the physical structure of the object to be examined, the neutron source 4 can be positioned closer to or farther away from the collimator 12. The ability to adjust the neutron source 4 in the direction of the arrows 8 and 9 permits the selectable assignment of the neutron source 4 to one or both of the two collimator ducts or lanes 7. If the neutron source is centered between two imaginary central axes of the collimation ducts 7, i.e., so as to be offset relative to the collimator input apertures 20, both collimator ducts can be acted upon by thermal neutrons, which is accompanied by an improvement of the efficiency of the neutron source, or a reduction of the ratio of the irradiation time to the irradiated unit area in the plane of the image. In addition, the offset disposition of the neutron source has the effect of permitting substantially only thermal neutrons to reach the object to be examined and therefore, neutrons with higher energy ($E>E_{therm}$) which could cause a non-illustrated gray veil on film following the object and could degrade the picture quality, are largely avoided. The ability to perform an adjustment in the direction of the arrow 10, together with the ability to perform an adjustment in the direction of the arrows 8 and 9, therefore provides a precise alignment of the neutron source 4 and thus an effective directional neutron flux. The placement of the space 17 and its plastic lining 13, permit a distinctly larger amount of thermal neutrons to arrive at the object to be examined. Irregularities of the neutron flux density in the region of the object, which could cause so-called shadow effects in the picture reproduction, for instance, are effectively prevented by an aperture 22 in the polyethylene coating 13 which is widened in the direction toward the wall 3.

The irradiation picture is captured in a conventional manner on a non-illustrated neutron-sensitive film following the object.

I claim:

1. Device for irradiating an object, comprising a source mount, a source disposed on said source mount for generating thermal neutron rays, a moderator surrounding said source for primary moderation, a collimator having a ray inlet side with an inner surface and at least one funnel-shaped collimator duct for the neutron rays opening toward an object, a neutron-permeable wall disposed downstream of said moderator in neutron flow direction and separating said source mount from said ray inlet side of said collimator defining a space downstream of said wall between said wall and said ray inlet side with an inner peripheral surface of said space, and a plastic plating disposed on said inner peripheral surface of said space and on said inner surface of said ray inlet side for secondary moderation defining an opening of said at least one collimator duct free of said plastic plating.

2. Device according to claim 1, including means for moving said source mount together with said neutron source relative to said collimator in axial direction and transverse to axial direction of said at least one collimation duct.

3. Device according to claim 2, wherein said moderator is a solid body in which said source is disposed, and said moving means moves said solid body together with said source mount.

4. Device according to claim 3, wherein said plastic plating has an aperture formed therein defining lateral surfaces of said plastic plating diverging relative to each other as seen in direction toward said wall.

5. Device according to claim 2, wherein said plastic plating has an aperture formed therein defining lateral surfaces of said plastic plating diverging relative to each other as seen in direction toward said wall.

* * * * *